US008714070B2

(12) United States Patent
Martinez et al.

(10) Patent No.: US 8,714,070 B2
(45) Date of Patent: May 6, 2014

(54) NON-LETHAL WATERBORNE THREAT DETERRENT AND IMMOBILIZATION DEVICE

(71) Applicants: Martin A. Martinez, Phoenix, AZ (US); Patrick J. Barnhill, Phoenix, AZ (US); Michael W. Niederschulte, Phoenix, AZ (US); Brian D. Rosner, Phoenix, AZ (US)

(72) Inventors: Martin A. Martinez, Phoenix, AZ (US); Patrick J. Barnhill, Phoenix, AZ (US); Michael W. Niederschulte, Phoenix, AZ (US); Brian D. Rosner, Phoenix, AZ (US)

(73) Assignee: Engineering Science Analysis Corp, Tempe, AZ (US)

( * ) Notice: Subject to any disclaimer, the term of this patent is extended or adjusted under 35 U.S.C. 154(b) by 0 days.

(21) Appl. No.: 13/956,090

(22) Filed: Jul. 31, 2013

(65) Prior Publication Data

US 2014/0033907 A1 Feb. 6, 2014

Related U.S. Application Data

(60) Provisional application No. 61/741,972, filed on Aug. 1, 2012.

(51) Int. Cl.
*B63G 9/04* (2006.01)

(52) U.S. Cl.
USPC ..... 89/1.34; 89/5; 89/1.11; 114/317

(58) Field of Classification Search
USPC ..... 89/1.34, 1.1, 1.11, 37.06, 5; 114/317, 114/382, 14; 441/2, 30
See application file for complete search history.

(56) References Cited

U.S. PATENT DOCUMENTS

| | | | | |
|---|---|---|---|---|
| 5,750,918 | A * | 5/1998 | Mangolds et al. | 102/502 |
| 6,394,016 | B2 * | 5/2002 | Swartout et al. | 114/254 |
| 7,441,511 | B2 * | 10/2008 | Farinella et al. | 114/382 |
| 7,882,775 | B2 * | 2/2011 | Martinez et al. | 89/1.34 |
| 8,245,617 | B2 * | 8/2012 | Martinez et al. | 89/1.34 |
| 8,596,178 | B2 * | 12/2013 | Rogers et al. | 89/1.11 |
| 8,601,928 | B2 * | 12/2013 | Martinez et al. | 89/1.34 |
| 2007/0017432 | A1 * | 1/2007 | Farinella et al. | 114/382 |
| 2011/0005373 | A1 * | 1/2011 | Martinez et al. | 89/1.34 |
| 2011/0005374 | A1 * | 1/2011 | Martinez et al. | 89/1.34 |
| 2011/0030540 | A1 * | 2/2011 | Martinez et al. | 89/1.34 |
| 2013/0291710 | A1 * | 11/2013 | Martinez et al. | 89/1.34 |

FOREIGN PATENT DOCUMENTS

| | | | | |
|---|---|---|---|---|
| GB | 2172853 | A * | 10/1986 | B63G 9/04 |

* cited by examiner

*Primary Examiner* — Benjamin P Lee
(74) *Attorney, Agent, or Firm* — Douglas W. Rudy

(57) ABSTRACT

An interdiction device that includes a net for trapping and containing a target swimmer, diver or water-borne vessel. The net is deployed from the interdiction device that is either initially submerged in a body of water or floating on the surface of the body of water. The net is deployed either below the surface of the water in one embodiment or on the surface of the water depending on the desired function.

10 Claims, 4 Drawing Sheets

NON-LETHAL WATERBORNE THREAT DETERRENT AND IMMOBILIZATION DEVICE

REFERENCE TO A RELATED APPLICATION

This application is a non-provisional patent application based on earlier filed provisional application No. 61/741,972, filed Aug. 1, 2012, and hereby incorporated by reference in its entirety. Applicant claims the benefit of all available priority from application No. 61/741,972 for this application.

BACKGROUND OF THE INVENTION

1. Field of the Invention

This invention is an interdiction device that includes a net for trapping and containing a target swimmer, diver or water-borne vessel. The net is deployed from the interdiction device that is either initially submerged in a body of water or floating on the surface of the body of water. The net is deployed either below the surface of the water in one embodiment or on the surface of the water depending on the desired function.

2. Description of Known Art

The applicant is aware of several related devices that are used to intercept a water-borne threat. For instance, the applicant has a pending patent application pertaining to entanglers that will impede the progress of a water-borne threat that approaches the entangler device.

Applicant believes that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicants will amend the specification to expressly recite the essential material that is incorporated by reference as allowed by the applicable rules.

BRIEF SUMMARY OF THE INVENTION

The present invention provides, among other things, an interdiction device including a net that is deployable from a submerged container or from a container floating on the surface of the water. In the situation where the container is submerged entirely the net will be deployed below the surface of the water. The net can also be deployed above and onto the surface of the water that the device is floating on or dropped into. Upon receiving a signal from a sensing device, either a device contained as part of the submerged container, in the submerged embodiment, or from a human observer, a signal will be sent to the submerged interdiction device to ascend to a predetermined position below the surface of the water where the interdiction device has been deployed, the device will fire torpedo like projectiles, the projectiles propelled by the momentum imparted by the firing mechanism (e.g. pneumatic, compressed gas, gas generator or chemical propulsion). Alternatively, the projectiles are self-propelled or be self-propelled or both self propelled or launched. The projectiles are attached to a net and the projectiles will pull/deploy and spread the net initially contained within the interdiction device housing. After the projectiles have traveled a distance, buoyancy bladders contained by the projectiles will inflate and will cause the net to rise toward the surface of the water and entrap the target in the net. The buoyancy bladders can be shaped so that the buoyancy forces lifting the bladders can cause the net to spread further as it rises to the surface. In addition, a separate projectile/bladder attached to a "cinching" line that is attached to the net may be employed to close the top of the net thus further restraining the target.

One object of this invention is to provide an interdiction device that is easily positioned from a RHIB and/or other surface vessel, deployed by an underwater vehicle manned or unmanned, or dropped from an aerial vehicle manned or unmanned.

An advantage of this invention is that the interdiction device can be deployed from various types of launching equipment such as, but not limited to sonobuoy launcher, torpedo tubes, hedgehog launcher, etc.

It is also an object to provide an aquatic interdiction device that is compact and will fit in security infrastructure for quick deployment.

It is also an object of this invention to have the interdiction device be either remotely activated or activated by a target-sensing device on or otherwise in communication with the interdiction device.

Another object of this invention is to provide a device that is reusable and reloadable rather than disposable.

Another object of this invention, in an alternative embodiment, is to provide a device that is disposable.

A further object and advantage of the interdiction device disclosed herein is that it doesn't leave toxic by-products in the water after use.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWING

A more complete understanding of the present invention may be derived by referring to the detailed description when considered in connection with the drawing figures wherein.

Elements and acts depicted in the figure are illustrated for simplicity. They are presented to illustrate the invention to assist in an understanding thereof. The figure is not necessarily been rendered according to any particular sequence, size, scale or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

Figure 1:
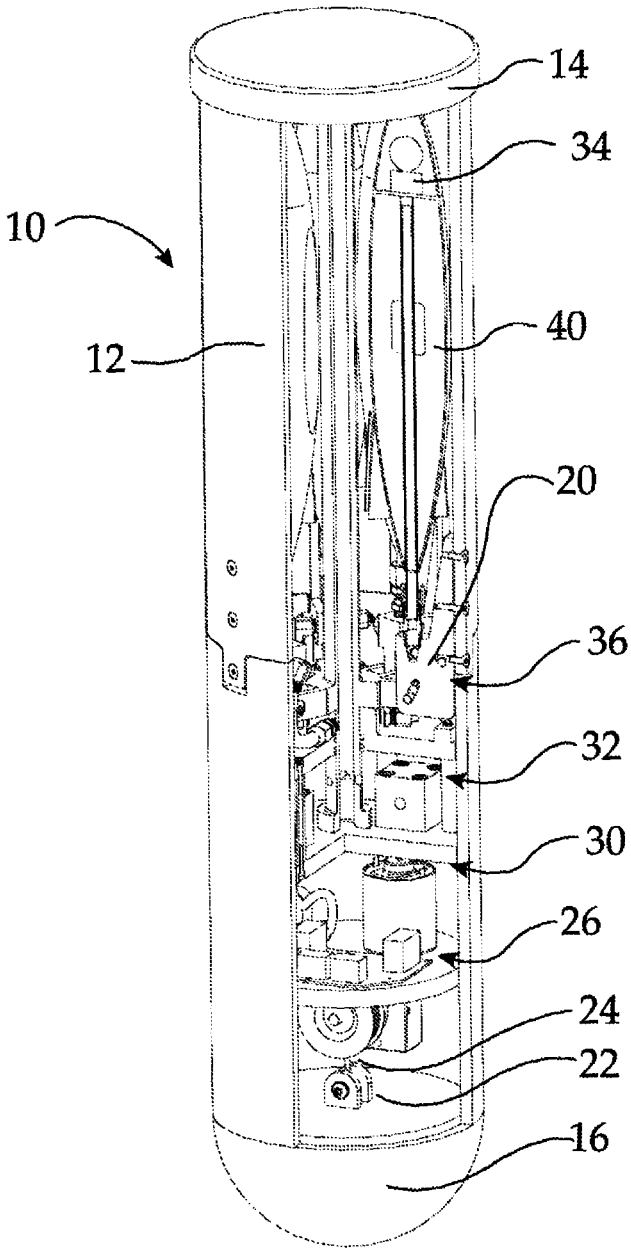
FIG. 1 is the interdiction device having a portion of the housing of the device removed to expose the interior of the interdiction device.

Turning to FIG. 1 there is shown a swimmer, diver and waterborne vessel interdiction device generally 10. A housing 12 is provided with an end cap 14 at an upper end of the housing and an anchor 16 at the opposite end of the housing 12. A portion of the housing 12 wall 20 has been removed to reveal the interior of the interdiction device.

Inside the interdiction device the top of the anchor 16 includes an attachment bracket to which a cable 24 is attached. The cable has one end attached to the housing. The cable 24 is adjustable to lower or raise the anchor using a winch system generally 26. An electronic module, generally 30, is also carried in the housing of the interdiction device. This module will control the functioning of the device, which may include but not limited to, sensing the position of the device, controlling the deployment of the anchor 16 by controlling the winch system 26. The electronic module 30 will also allow transmission and receiving of radio messages sent to or from the module from a remote transceiver. Another function of the electronic module 30 is to initiate, in response to a triggering signal, either from a remote human controlled device or from a proximity sensor proximate the interdiction device, the active deployment of the apparatus of the device used to deploy and control the position of the net of the device.

Also carried inside, in one embodiment, the housing 12 is a source of compressed gas such as, but not limited to, a gas cartridge, or gas generator. A gas delivery manifold array generally 32, is also carried in the housing. The source of compressed gas, such as the gas cartridges or gas generators will have the primary function of launching or firing the net towing torpedoes from the device, one shown in FIG. 1 as item 40. The gas, as delivered through the manifold array, may be used for other functions such as, but not limited to, maintaining the position of the interdiction device in the water, inflating the inflatable surfacing balloons or bladders, and, for instance, activating various elements of the mechanism of the interdiction device.

Figure 2:
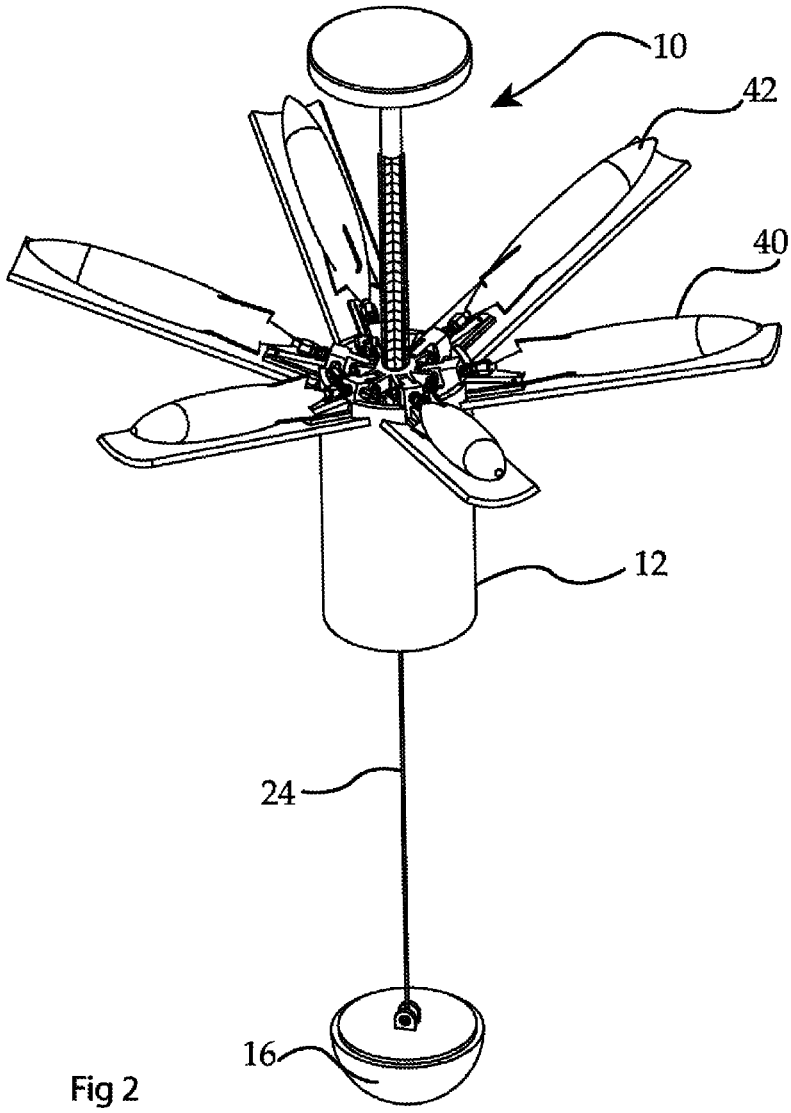
FIG. 2 is a depiction of the interdiction device partially deployed and in the process of completing its fully deployed function.
Figure 3:
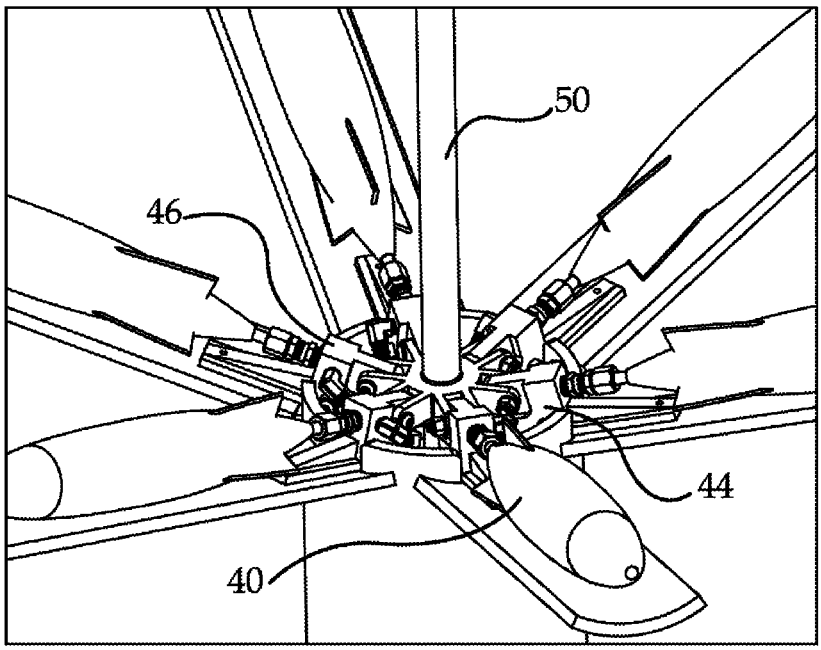
FIG. 3 is a depiction of the pivot mechanism of the interdiction device.

A pivot mechanism, generally 36, shown in more detail in FIG. 3, is also carried in the housing 12. When deployed to a position where the net of the device is ready to be deployed the six net towing torpedoes (there could be more or less than six of these), one shown as 40, the net towing torpedoes 40 will be pivoted into place as shown in FIGS. 2-4 on and facilitated by the pivot mechanism 36.

Figure 4:
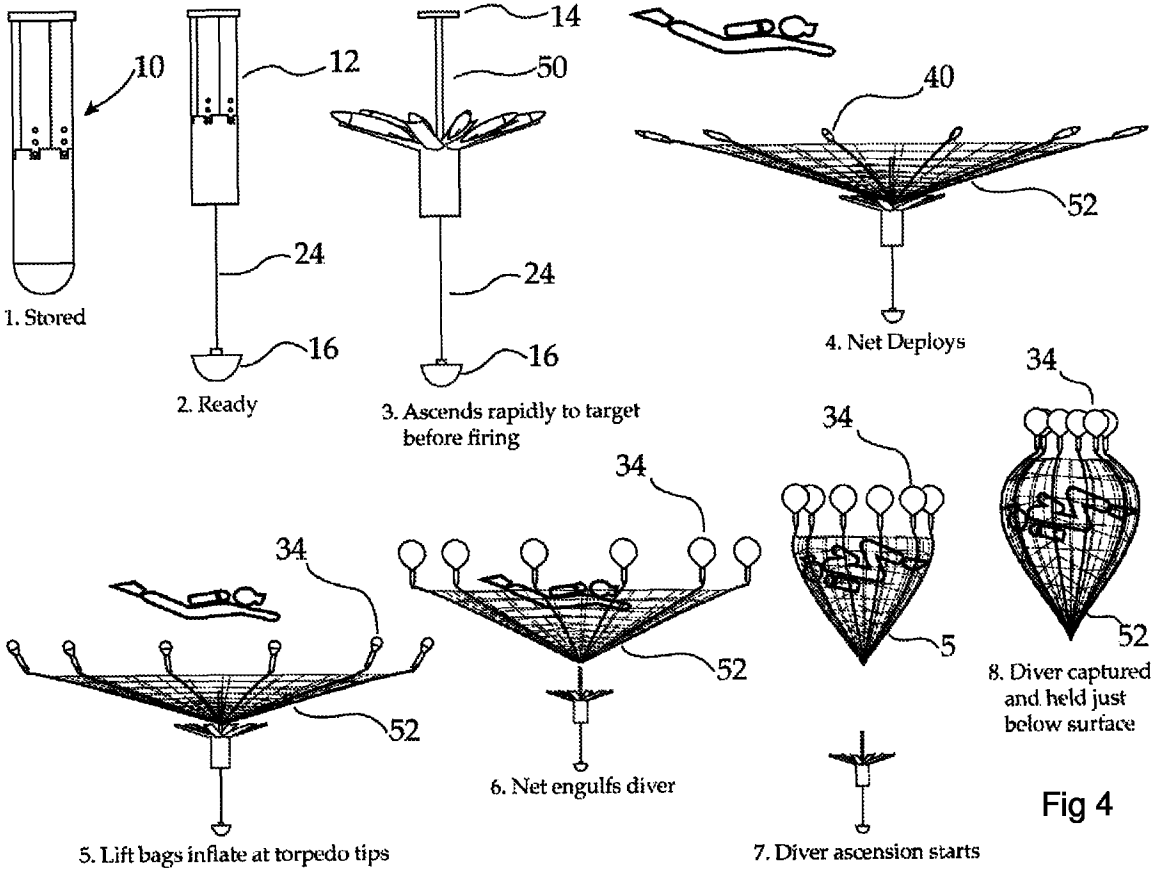
FIG. 4 is a pictorial representation of the various phases in the deployment of the device from a stored condition to the capture of a target in the net of the device.

The inflatable surfacing balloons 34, or other styles of inflatable bladders or pressure containing vessels, are carried on the net towing torpedoes 40 inside the housing until they are ready for deployment and inflation from the on-board source of gas pressure, as shown in FIG. 4.

FIG. 2 is a pictorial representation of the interdiction device partially deployed. In this figure the anchor 16 has been released from the bottom of the device and panels of the wall of the housing 12, whereon the net towing torpedoes 40 are mounted, are shown in a splayed-open configuration prior to firing of the net deploying projectiles (torpedoes in this instance) such as 42.

FIG. 3 is a detail presentation of the pivot mechanism, and other attendant components proximate the pivot mechanism. The pivot mechanism includes as hub 44 on which each of the support panels for each of the six net towing torpedoes 40 are carried. The hub 44, surrounding a central column 50, also carries manifold blocks, one for each of the net towing torpedoes, to supply compressed air to the inflatable surface balloons when needed.

FIG. 4 is a pictorial presentation of a sequence of deployment stages of the interdiction device. The device is shown going from a stored configuration as shown above caption 1 to the task completed figure above caption 8. The various captions explain each of the eight drawings. Not clearly shown in FIGS. 1-3 are the net 52 and the inflated balloons 34. In the figure showing "Net Deploys" the net towing torpedoes 40 are shown attached to and spreading out the net 52. In the following four pictures the inflation of the balloons is shown as a diver passes over the net 52. With the diver positioned over the net the balloons will rapidly bring the net toward the surface and as the net makes its way to the surface the net will close around the diver until the position as shown in the eight picture is accomplished. Not shown is the optional cinching device that will completely close the mouth of the net.

In a further embodiment of the invention the deployed net is deployed to be in position to interdict a swimmer or boat that is on the surface of the water. In this embodiment the interdiction device would be only partially submerged or floating on the water surface. When a swimmer, diver or vessel is proximate the device on the surface, the device is actuated to fire and launch the torpedoes and the attached net above the surface of the water. The net will fall down onto the surface of the water and trap the swimmer or the vessel under the net.

In yet another embodiment the interdiction device may fire the net prior to the swimmer or vessel entering a protected area. In this case the net will function as a deterrent/entangler as the swimmer or aquatic vessel will be deterred from entering the area or become entangled. In this embodiment the inflation of the balloons or buoyancy devices would be optional. If they were inflated it may keep the net and the trapped target on the surface of the water also, the inflated balloons would reduce the hydrodynamic efficiency of the entangled swimmer or vessel thus impeding a quick escape. If they are not inflated it may be that the weight of the net would exert sufficient downward force on the trapped swimmer or vessel to impede any further horizontal or vertical travel of the swimmer, diver or vessel.

In summary the invention comprises a non-lethal waterborne threat deterrent device having a housing with an end cap at an upper end of the housing, a source of compressed gas carried in the housing, an electronic module carried inside the housing, the module for controlling the functioning of the device, a plurality of net towing torpedoes carried in the housing, the net towing torpedoes deployable by being launched by the release of compressed gas to launch the net towing torpedoes, a net having attachment points to the net towing torpedoes whereby the net will be drawn from the housing when the net towing torpedoes are deployed from the housing, and a plurality of inflatable surfacing balloons carried on the net towing torpedoes, the inflatable surfacing balloons being inflated during deployment of the net by the net towing torpedoes.

The housing also carries an anchor. This anchor includes an attachment bracket attached to a cable and the cable attached to the housing.

An electronic module allows for the transmission and receiving of radio messages to or from a remote transceiver. The electronic module initiates the deployment of the apparatus of the device used to deploy and control the position of the net carried by the device. In one embodiment the electronic module initiates active deployment of the net towing torpedoes in response to a signal from a proximity sensor proximate the non-lethal waterborne threat deterrent device. In another embodiment the electronic module initiates active deployment of the net towing torpedoes in response to a signal from a remote human controlled device.

The compressed gas used to launch the torpedoes and inflate the balloons may be a source of gas such as a gas cartridge or gas produced from a gas generator.

The net towing torpedoes are initially supported on a pivot mechanism carried in the housing. When deployed to a position where the net of the device is ready to be deployed the net towing torpedoes will be pivoted into position for launching of the net and the plurality of inflatable surfacing balloons carried on the net towing torpedoes, the inflatable surfacing balloons being inflated during deployment of the net by the net towing torpedoes.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments nor the abstract defines or constrains the invention. Rather, the issued claims variously define the invention. Each variation of the invention is limited only by the recited limitations of its respective claim, and equivalents thereof, without limitation by other terms not present in the claim.

The invention claimed is:

1. A non-lethal waterborne threat deterrent device comprising:

a housing having an end cap at an upper end of the housing;

a source of compressed gas carried in the housing;

an electronic module carried inside the housing, the module for controlling the functioning of the device;

a plurality of net towing torpedoes carried in the housing, the net towing torpedoes deployable by being launched by the release of compressed gas to launch the net towing torpedoes;

a net having attachment points to the net towing torpedoes whereby the net will be drawn from the housing when the net towing torpedoes are deployed from the housing;

a plurality of inflatable surfacing balloons carried on the net towing torpedoes, the inflatable surfacing balloons being inflated during deployment of the net by the net towing torpedoes.

2. The invention in accordance with claim 1 comprising the electronic module allowing the transmission and receiving of radio messages to or from a remote transceiver.

3. The invention in accordance with claim 2 comprising an anchor carried in the housing, the anchor including an attachment bracket attached to a cable and the cable attached to the housing.

4. The invention in accordance with claim 3 wherein the electronic module initiates the deployment of the apparatus of the device used to deploy and control the position of the net carried by the device.

5. The invention in accordance with claim 4 wherein the electronic module initiates active deployment of the net towing torpedoes.

6. The invention in accordance with claim 5 where in the electronic module initiates active deployment of the net towing torpedoes in response to a signal from a proximity sensor proximate the non-lethal waterborne threat deterrent device.

7. The invention in accordance with claim 5 where in the electronic module initiates active deployment of the net towing torpedoes in response to a signal from a remote human controlled device.

8. The invention in accordance with claim 7 where the source of compressed gas is a gas cartridge.

9. The invention in accordance with claim 7 where the source of compressed gas is a gas generator.

10. The invention in accordance with claim 1 further comprising a pivot mechanism carried in the housing whereby when deployed to a position where the net of the device is ready to be deployed the net towing torpedoes will be pivoted into position for launching of the net and the plurality of inflatable surfacing balloons carried on the net towing torpedoes, the inflatable surfacing balloons being inflated during deployment of the net by the net towing torpedoes.

* * * * *